United States Patent [19]

Markus

[11] Patent Number: 4,998,301

[45] Date of Patent: Mar. 12, 1991

[54] COLLAPSIBLE BED-PAN SUPPORT FOR INVALIDS

[76] Inventor: Robert Markus, 512 Monterey La., #A, San Clement, Calif. 92672

[21] Appl. No.: 441,330

[22] Filed: Nov. 27, 1989

[51] Int. Cl.[5] ..... A61G 9/00

[52] U.S. Cl. ..... 4/457; 4/456; 5/81 R; 5/454; 5/455

[58] Field of Search ..... 4/450–457; 5/81 R, 441, 449, 453–455

[56] References Cited

U.S. PATENT DOCUMENTS

| | | | |
|---|---|---|---|
| 574,503 | 1/1897 | Van Meter | 5/455 X |
| 1,132,056 | 3/1915 | Wesley et al. | 4/456 X |
| 1,676,962 | 7/1928 | Murphy | 4/456 |
| 2,099,977 | 11/1937 | Harris | 5/455 X |
| 2,198,804 | 4/1940 | Carlsson | 4/456 X |
| 2,224,353 | 12/1940 | Laufenburg | 4/456 |
| 2,612,645 | 10/1952 | Boland | 5/441 |
| 3,008,153 | 11/1961 | Coulter | 4/456 X |
| 3,609,771 | 10/1971 | Avoy | 4/451 |
| 3,628,197 | 12/1971 | Leventhal et al. | 4/113 |
| 3,728,744 | 4/1973 | Kimbro et al. | 4/113 |
| 4,207,633 | 6/1980 | Smith et al. | 5/90 |
| 4,592,589 | 6/1986 | Hellwig | 5/441 X |
| 4,723,329 | 2/1988 | Vaccaro | 5/449 X |

FOREIGN PATENT DOCUMENTS

| | | | |
|---|---|---|---|
| 438144 | 12/1926 | Fed. Rep. of Germany | 4/456 |

*Primary Examiner*—Charles E. Phillips

*Attorney, Agent, or Firm*—Milton S. Gerstein

[57] ABSTRACT

A collapsible bed-pan support for bed-ridden persons, which has an upper supporting surface that inclines from its head-end toward its feet-end in order to gradually elevate the back of the patient. A series of webs of different height provide for the upper sloping supporting surface. The support is made of thin, flexible material that, when collapsed, is only about 1.5 mm. thick, so that the bed-pan support may remain underneath the patient until required for the next use of a bed pan.

3 Claims, 2 Drawing Sheets

COLLAPSIBLE BED-PAN SUPPORT FOR INVALIDS

BACKGROUND OF THE INVENTION

The present invention is directed to a collapsible support for a bed-pan for use in hospitals or in the home for persons that are too ill to leave the bed. Inflatable bed-pan supports are known, one such being disclosed in U.S. Pat. No. 3,728,744—Kimbro, et al. Another bed-pan support is disclosed in U.S. Pat. No. 4,207,633—Smith et al. While these prior-art bed-pan supports are useful, they do not provide the comfort, ease of use, and support as that of the present invention. The prior-art, inflatable bed-pan supports generally must be repositioned under the patient each time the bed pan is to be used, and then inflated. After use, the support is deflated and then removed for subsequent use, and cannot generally be allowed to remain under the patient after use, owing to the discomfort caused by remaining under the patient, even in its deflated state. In addition, when inflated and used to lift the body of the patient for positioning the bed pan under the patient and on the support proper, the prior-art bed-pan supports provide little support to the patient's body and can cause unnecessary strain owing to the general design thereof, which design simply allows for the lifting up of the patients lower back and buttocks, without any regard as to most the advantageous and most comfortable way of doing such lifting while also providing the greatest support to the body.

SUMMARY OF THE INVENTION

It is, therefore, the primary objective of the present invention to provide a collapsible bed-pan support for use in hospitals as well as in the home for bed-ridden persons which provides much greater ease of use, and provides enhanced structural support to the lower back, buttocks area, and thighs of the person in a manner that provides enhanced comfort while also providing greater support.

It is another objective of the present invention to provide a collapsible bed-pan support that is easily inflatable, and which, in its collapsed state is of such small thickness, so as to allow for its continued placement underneath the patient, where it is readily available for the next use of a bed pan.

It is still another objective of the present invention to provide an improved, collapsible, bed-pan support that elevates the patient's body in gradual steps, such that the patient is lifted up in an inclined or sloping manner from the upper back portion toward the thighs, which not only provides greatly increased comfort to the patient, but also considerably reduces strain and pressure on the upper and lower back regions, because of this gradual rise in elevation.

Toward these and other ends, the collapsible, bed-pan support of the invention is made of very thin nylon or PVC/nylon laminate having a thickness of approximately 20 gauge, or 0.75 mm. This exceptionally thin material allows the bed-pan support of the invention to collapse to a thickness of just 150 mm. when the upper layer collapses on the lower layer. The upper layer or upper support surface of the collapsible support of the invention defines an upwardly sloping support surface that supports the body so as to cause upward sloping of the body from the back towards the buttocks and thigh areas of the patient. Concave depressions are formed in the lower end regions of the upper support layer or surface for receiving comfortably therein the thighs of the patient, for firm support thereby.

BRIEF DESCRIPTION OF THE DRAWINGS

The invention will be more readily understood with reference to the accompanying drawing, wherein.

DETAILED DESCRIPTION OF THE INVENTION

Figure 1:
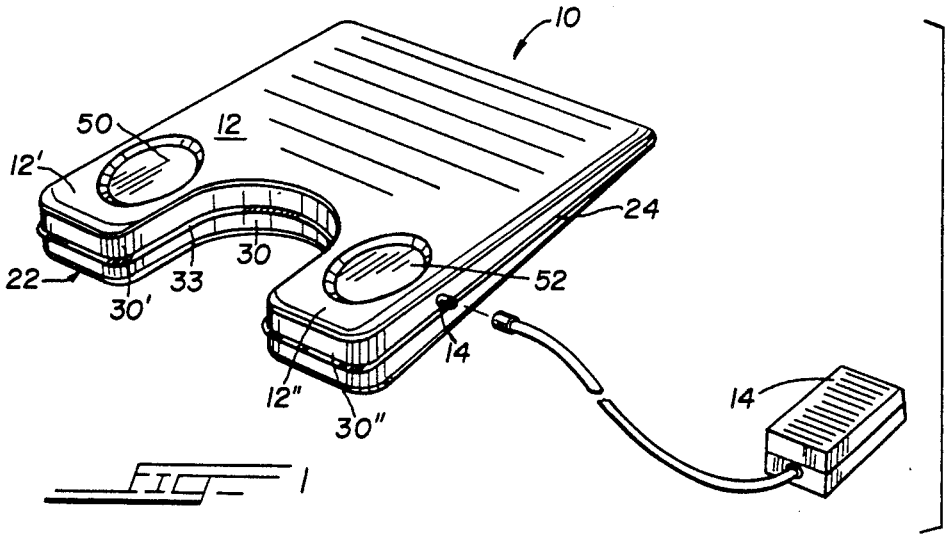
FIG. 1 is a perspective view showing the collapsible bed-pan support of the invention in its inflated, ready-to-use state.
Figure 2:
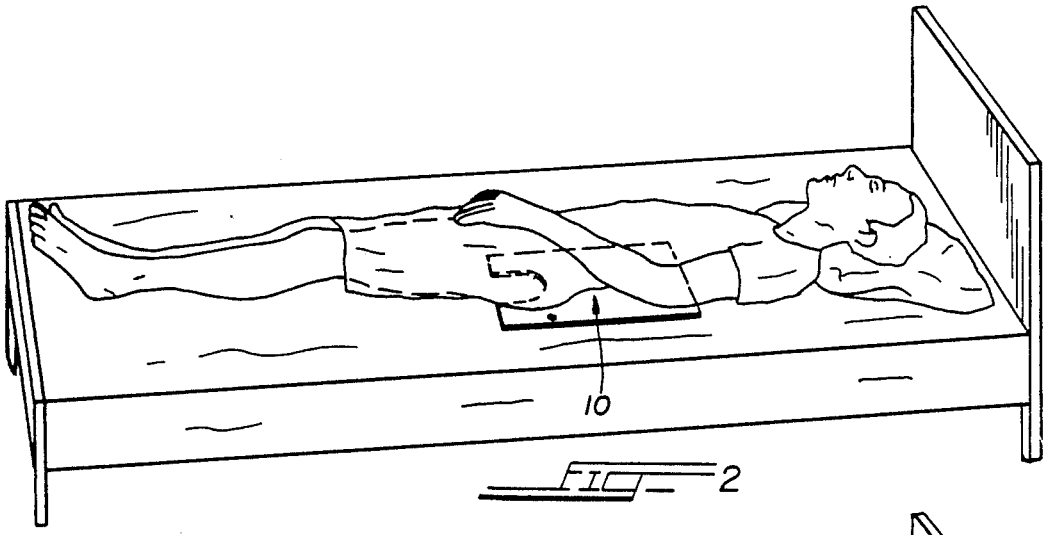
FIG. 2 is a perspective view showing the bed-pan support of the invention in its collapsed state under a bed-ridden patient, where the support remains until it is inflated for use.
Figure 3:
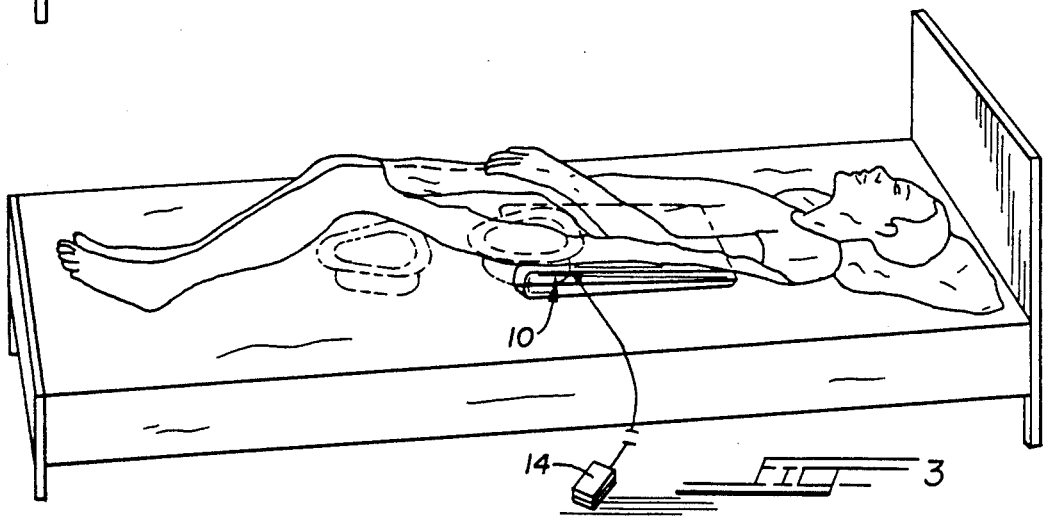
FIG. 3 is a perspective view similar to FIG. 2 but showing the bed-pan support of the invention in its erected, inflated state for use in supporting a bed pan.
Figure 4:
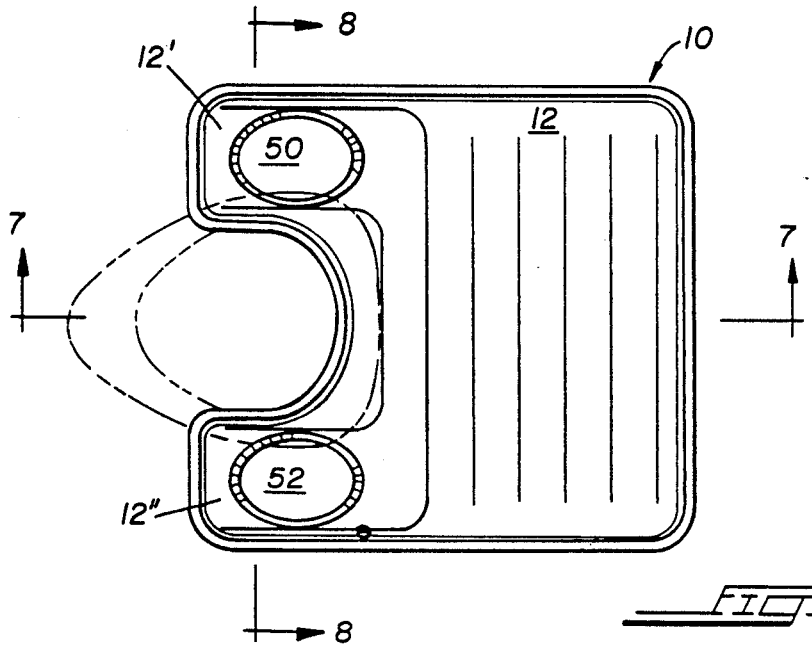
FIG. 4 is a top plan view of the collapsible bed-pan support of the invention.
Figure 5:
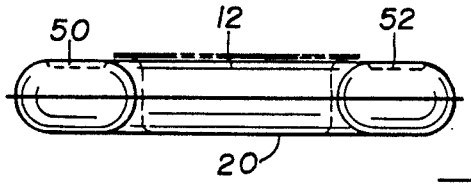
FIG. 5 is a front end view thereof.
Figure 6:
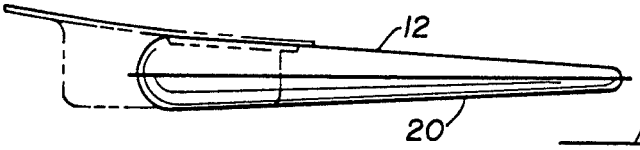
FIG. 6 is a side elevational view thereof, with a bed pan shown in dotted lines.
Figure 7:
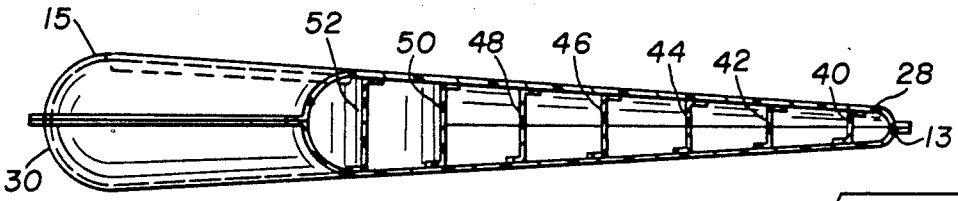
FIG. 7 is a cross-sectional view taken along line 7—7 of FIG. 4.
Figure 8:
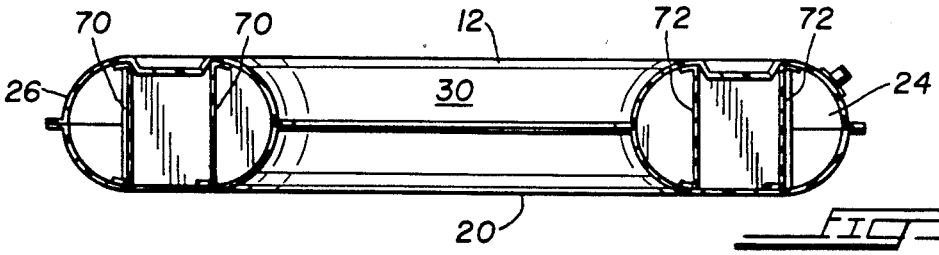
FIG. 8 is a cross-sectional view taken along line 8—8 of FIG. 4.

Referring now to the drawings in greater detail, the collapsible, bed-pan support for bed-ridden patients is indicated generally by reference numeral 10. The bed-pan support 10 is made of very thin nylon or a laminate of PVC/nylon, having a complete thickness of between 0.50 mm. and 2.00 mm., with the preferred being 0.75 mm. This very thin material allows for the bed-pan support to be collapsed to about 1.5 mm. in thickness, as explained below, which allows for the support to remain under the patient in its collapsed state, and thereby immediately ready for use via inflation. Owing to the nature of the material used, not only is the collapsed support able to remain under the patient, but it actually provides a feel of comfort to him. The bed-pan support 10 has an upper support face or layer 12 upon which the patient's back, buttocks area and thighs rest when the support is erected via a valve 14 and compressed-air supply 16. The support 10 includes a flat or horizontally-disposed bottom support surface or layer 20 (FIGS. 5–8), which rests directly on the bed. The perimetric edges of the two layers 12 and 20 are united by an annular or circumferential side wall surface 22 comprised of side walls 24, 26 rear wall 28, and front wall 30. In actual manufacture, an upper and lower half will be radio-frequency welded to each other along a weld-line 33 about the entire intermediate circumference o the annular side wall surface 22, as seen in FIGS. 1, 7 and 8, so that, when the unit is in its collapsed state, shown in FIG. 2, the approximate overall thickness of the collapsed unit is twice the thickness of each of the upper or lower layers 12, 20, or about 1.5 mm., which, as set forth above, allows for the unit to remain in place under the patient when not being used and readily available for the next bed-pan use. The unit's front surface 30 defines a U-shaped opening which receives a bed pan, shown in dotted lines in FIGS. 3, 4 and 6, in a conventional manner. The upper surface face or layer 12 inclines or slopes upwardly from top to bottom, with reference to the body of the patient as shown in FIG. 3, or from right to left when viewing FIG. 1. The amount of slope, in the preferred embodiment is approximately 15 degrees, with the length of the unit being 36 inches and the greatest height, which occurs at the two forward-most front surfaces 30', 30", being 3.5 inches. Such an incline surfaces gradually elevates the back, buttocks and thigh regions of the patient, to not only provide enhanced comfort, but also greater lower back support, allowing for longer bed-pan use times. The width of the unit is preferably 20 inches. The interior of the support 10 is substantially hollow, except for a plurality of flexible connecting webs 40 through 52, each web defining an upper portion that is connected to an interior portion of the upper support surface 12, and a lower portion connected to an interior portion of the lower support surface 20. The webs extend perpendicular to the length of the support 10, are of different heights, and are arranged in the order of their heights, starting with the lowest height and upward, from left to right when viewing FIG. 7, which corresponds to the head-end of the support 10 and the feet-end thereof, respectively. The webs are flexible enough, so that when the support 10 is collapsed, the upper layer 10 and the lower layer 20 may rest one upon the other, as shown in FIG. 2, so that it may be retained in place under the body of the patient, in its collapsed state, until inflated the next time for supporting the bed pan. The head-end 13, which corresponds to the rear end of the annular wall 22, has a height lower than the lowest connecting web 40, while the feet-end 15, or the forward end of the annular wall 22, has a height greater than the highest connecting web 52, so that the upper supporting surface 12 inclines in a substantially linear manner, as shown in FIGS. 6 and. 7. The portions 12' 12" of the upper surface 12 which defines part of the U-shaped cutout, also incline the same slope as the remainder of the upper supporting surface, as clearly shown in FIGS. 6 and 7, so that the upper surface 12 defines the linear sloping surface above-mentioned. Within these portions 12', 12" of the upper support surface 12, there are provided indentations or recesses 50, 52 which nestle therein portions of the thighs of the patient, to provide comfort as well as to prevent the slipping off of the thighs and buttcoks areas from the support surface 12. While the recesses 50, 52 are shown as oval shaped in the drawings, the feet-end parts thereof may open all the way to the front wall surfaces 30', 30" juxtapositioned thereat, whereby longer such recesses are provided. It is also noted that the interior volume of the two legs of the support 10 are provided with connectings webs 70, 72, as shown in FIG. 8, which serve the same purpose as the webs 40–52, the webs 70, 72 extending perpendicularly to the webs 40-52. It is within the scope and purview of the invention to provide webs that extend parallel to the length of the support 10, with the webs being parallel to each other, with each having an upper portion connected to the interior of the upper surface 12 along most of the length of the surface 12, with each web increasing in height along the length thereof from the head-end toward the feet-end.

While a specific embodiment of the invention has been shown and described, it is to be understood that numerous changes and modifications may be made therein without departing from the scope, spirit and intent of the invention as set forth in the appended claims.

What I claim is:

1. A collapsible bed-pan support for bed-ridden persons, and the like, comprising:

an upper body-supporting surface having a head-end and a feet-end;

a lower flat surface for resting on a bed, or the like having a head-end and a feet-end;

an annular surface connecting said upper body-supporting surface and said lower flat surface together and defining a substantially hollow interior that may be inflated for erecting the bed-pan support, said annular surface comprising a front surface;

one of said surfaces having means for injecting aN inflating gas into said substantially hollow interior;

said upper body-supporting surface being sloped and inclining upwardly in a direction from said head-end toward said feed-end;

means for spacing said upper body-supporting surface from said lower flat surface, said means for spacing comprising an upper portion connected to the interior surface of said upper body-supporting surface and a lower portion connected to the interior surface of said lower flat surface; said means for spacing mounting said upper body-supporting surface with respect to said lower flat surface, when the bed-pan support is inflated, such that said upper body-supporting surface slopes and inclines upwardly in a direction from said head-end thereof toward the feet-end thereof, so that the patient under whom the bed-pan is placed has his body gradually elevated from the back toward the thighs;

said front surface of said annular surface defining a substantially U-shaped cutout for receiving and supporting a bed-pan;

said upper body-supporting surface comprising pair of troughs, one on one lateral side of said U-shaped cutout, and the other on the other lateral side of said U-shaped cutout, for supporting and resting thereon a thigh of the patient.

2. The collapsible bed-pan support according to claim 1, wherein said upper body-supporting surface slopes upwardly from said head-end toward said feet-end at a constant angle.

3. The collapsible bed-pan support according to claim 1, wherein said means for spacing comprises a pluaraity of webs, each said web being made of flexible material that allows said upper support surface to lie flush on said lower support surface when the inflating gas is released from said hollow interior, whereby said bed-pan support may remain in place under the patient on the bed, or the like.

* * * * *